US009553379B2

(12) United States Patent
Liu et al.

(10) Patent No.: US 9,553,379 B2
(45) Date of Patent: Jan. 24, 2017

(54) ELECTRICAL CONNECTOR FOR A CHIP MODULE

(71) Applicant: LOTES CO., LTD, Keelung (TW)

(72) Inventors: Xu Jun Liu, Keelung (TW); Che Che, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/883,373

(22) Filed: Oct. 14, 2015

(65) Prior Publication Data

US 2016/0285184 A1 Sep. 29, 2016

(30) Foreign Application Priority Data

Mar. 24, 2015 (CN) ..... 2015 2 0165221

(51) Int. Cl.
*H01R 12/70* (2011.01)
*H01R 13/629* (2006.01)

(52) U.S. Cl.
CPC ..... *H01R 12/7076* (2013.01); *H01R 13/629* (2013.01)

(58) Field of Classification Search
CPC ..... H01R 13/629
USPC ..... 439/660, 68, 73, 342, 629, 259, 312
See application file for complete search history.

(56) References Cited

U.S. PATENT DOCUMENTS 6,570,398 B2 * 5/2003 Murphy ..... G01R 1/0458 324/756.02
2009/0042430 A1 * 2/2009 Ho ..... H05K 7/1053 439/312
2011/0294330 A1 * 12/2011 Dai ..... H05K 7/1053 439/331

* cited by examiner

*Primary Examiner* — Abdullah Riyami
*Assistant Examiner* — Justin Kratt
(74) *Attorney, Agent, or Firm* — Locke Lord LLP; Tim Tingkang Xia, Esq.

(57) ABSTRACT

An electrical connector includes a socket, a stiffener disposed around the periphery of the socket, and a load plate covering the socket. The load plate includes two opposite lateral sides, and a front side and a rear side connected to the two lateral sides, which define an opening for a chip module to pass through. The rear side includes a pivoting portion, such that the load plate is rotatable relative to the socket around the pivoting portion. Each lateral side includes a first pressing portion and a second pressing portion in front of the first pressing portion. When the chip module is installed onto the socket and the load plate is closed, the first and second pressing portion press the chip module, and distances from bottom surfaces of the first and second pressing portions to a top surface of the load plate is unequal.

16 Claims, 11 Drawing Sheets

ELECTRICAL CONNECTOR FOR A CHIP MODULE

CROSS-REFERENCE TO RELATED APPLICATION

This non-provisional application claims priority under 35 U.S.C. §119(a) on Patent Application No. 201520165221.4 filed in P.R. China on Mar. 24, 2015, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector for electrically connecting with a chip module.

BACKGROUND OF THE INVENTION

Chinese Patent Application No. 200720034625.5 discloses an electrical connector. The electrical connector includes an insulating body, several conducting terminals received in the insulating body, a retaining frame framing the periphery of the insulating body, and a lever and a press plate pivoted to two sides of the retaining frame. A hollow accommodating portion is disposed in the middle of the press plate. Four inner sides are disposed around the accommodating portion. A pair of elastic urging arms protruding toward the retaining frame is disposed at two of four inner sides to press against a chip module, and one of the other inner sides is provided with a bump protruding from a bottom surface of the press plate to press the chip module, so as to implement stable electrical connection between the chip module and a circuit board. However, the urging arms and the bump are the same in height, and when the press plate presses the chip module downward, the chip module is subject to an unbalanced force, which damages the terminals.

Therefore, a heretofore unaddressed need exists in the art to address the aforementioned deficiencies and inadequacies.

SUMMARY OF THE INVENTION

In one aspect, the present invention is directed to an electrical connector that provides a balanced force for a chip module.

In one embodiment, an electrical connector includes a socket used for electrically connecting with a chip module, a stiffener disposed around the periphery of the socket, a load plate covering the socket, and a latch member latching the load plate onto the stiffener. The load plate is provided with two opposite lateral sides, and a front side and a rear side connected to the two lateral sides. The two lateral sides, the front side and the rear side together define an opening for the chip module to pass through. The rear side is provided with a pivoting portion, to make the load plate rotate about the pivoting portion. Each of the lateral sides is provided with a first pressing portion. The load plate is further provided with a second pressing portion located in front of the first pressing portion. When the chip module is installed onto the socket and the load plate is closed, the first pressing portion and the second pressing portion press the chip module downward, and a distance from a bottom surface of the second pressing portion to a top surface of the load plate is unequal to a distance from a bottom surface of the first pressing portion to the top surface of the load plate.

In one embodiment, the distance from the bottom surface of the first pressing portion to the top surface of the load plate is greater than the distance from the bottom surface of the second pressing portion to the top surface of the load plate.

In one embodiment, the first pressing portion is nearer to the rear side than the first pressing portion is to the front side.

In one embodiment, the second pressing portion is disposed at the front side.

In one embodiment, the second pressing portion is disposed at the lateral side.

In one embodiment, the stiffener is provided with a cooperation hole pivoted to the pivoting portion, and a gap exists between the pivoting portion and an upper edge of the cooperation hole, so that the pivoting portion is movable upward in the cooperation hole.

In one embodiment, the first pressing portion and the second pressing portion protrude from an inner edge of the opening downward, and the first pressing portion and the second pressing portion are bumps.

In one embodiment, the latch member includes a first arm and a second arm pivoted to the load plate and located at two opposite sides of the load plate, and an operation arm connected to the first arm and the second arm and located behind the pivoting portion. A front side of the stiffener is provided with a first fixing hole and a second fixing hole. The stiffener is provided with a first grab and a second grab close to the operation arm. The first fixing hole and the first grab jointly press the first arm downward, and the second fixing hole and the second grab jointly press the second arm downward.

In one embodiment, the first arm has a pivoting arm engaging with the first fixing hole, and a connection arm engaging with the first grab and connected to the pivoting arm and the operation arm. The connection arm and the pivoting arm axially offset from each other, the connection arm is farther away from the load plate than the pivoting arm, and the pivoting arm is pivotally attached to the load plate.

In one embodiment, the first grab and the second grab are consistent in orientation, so that after the first arm and the second arm deflecting toward a same direction, the first arm and the second arm are fastened to the first grab and the second grab.

In one embodiment, a tab extends outward from each of two opposite sides of the load plate. Each of the first arm and the second arm is provided with a pivoting hole pivoted to the tab, and a gap exists between the tab and each of an upper edge and a lower edge of the corresponding pivoting hole.

In one embodiment, a protrusion protrudes below the pivoting hole from each of the first arm and the second arm, and the stiffener is provided with a reserved hole receiving the protrusion.

In one embodiment, a pressed portion extends outward from each of two opposite sides of the load plate, and each of the first arm and the second arm press the pressed portion downward.

In one embodiment, the stiffener is provided with a through-slot receiving the pressed portion.

In one embodiment, the operation arm is provided with an operation portion extending inward for an operator to operate the latch member.

In one embodiment, each of the front side and the rear side is provided with the latch member.

In one embodiment, the stiffener is provided with a stopping portion located behind the pivoting portion and stopping the load plate from excessively rotating backward.

Compared with the related art, the present invention has the following beneficial effects:

The height of the bottom surface of the first pressing portion is less than the height of the bottom surface of the second pressing portion, and when the load plate presses the chip module downward, the chip module can be subject to a balanced force, so as to prevent a terminal from being damaged.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
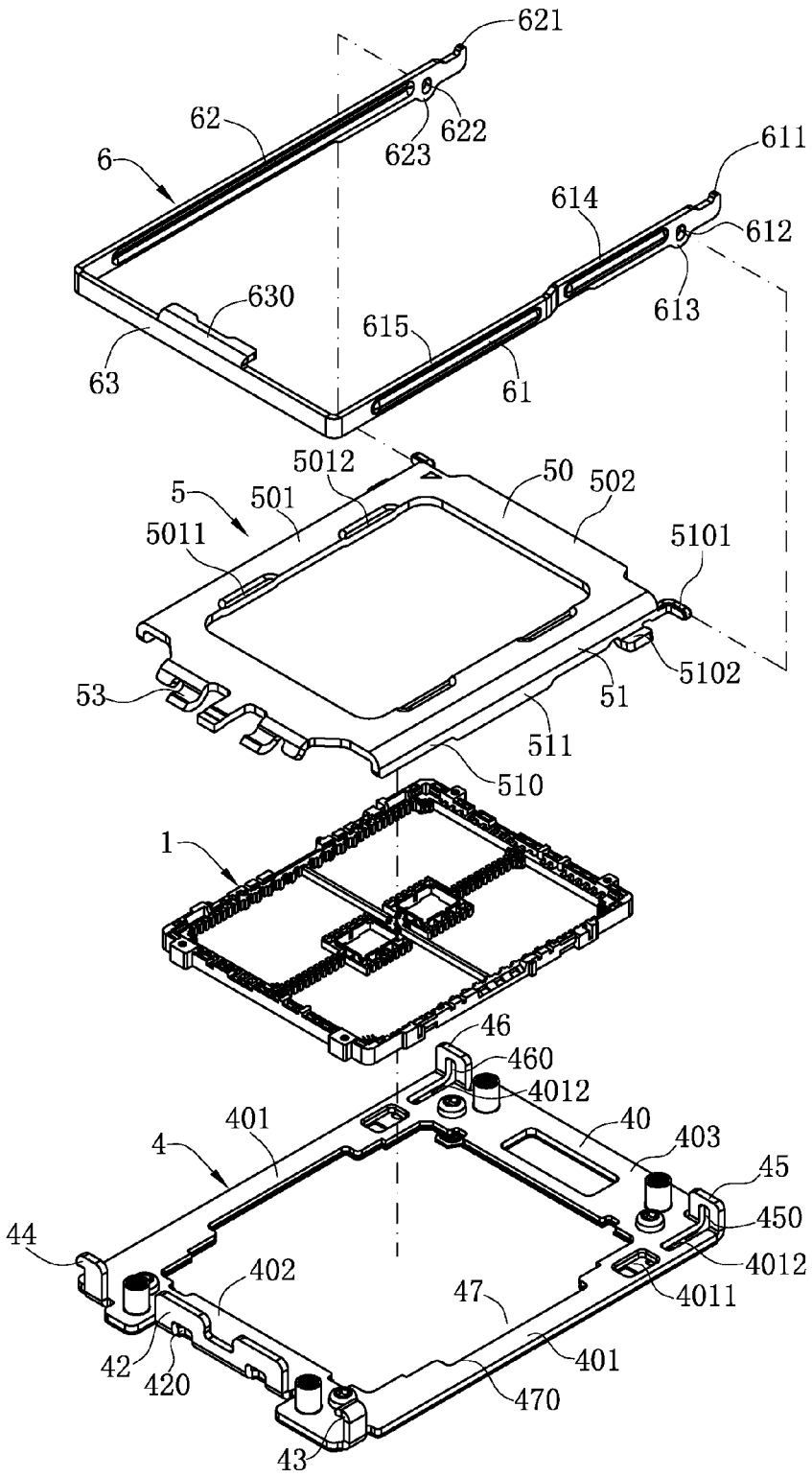
FIG. 1 is a schematic three-dimensional exploded view of an electrical connector according to one embodiment the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

As shown in FIG. 1 to FIG. 6, the present invention relates to an electrical connector, including an socket 1 electrically connecting a chip module 2 to a circuit board 3, a stiffener 4 disposed around the periphery of the socket 1, a load plate 5 covering the socket 1, and a latch member 6 latching the load plate 5 onto the stiffener 4.

Figure 2:
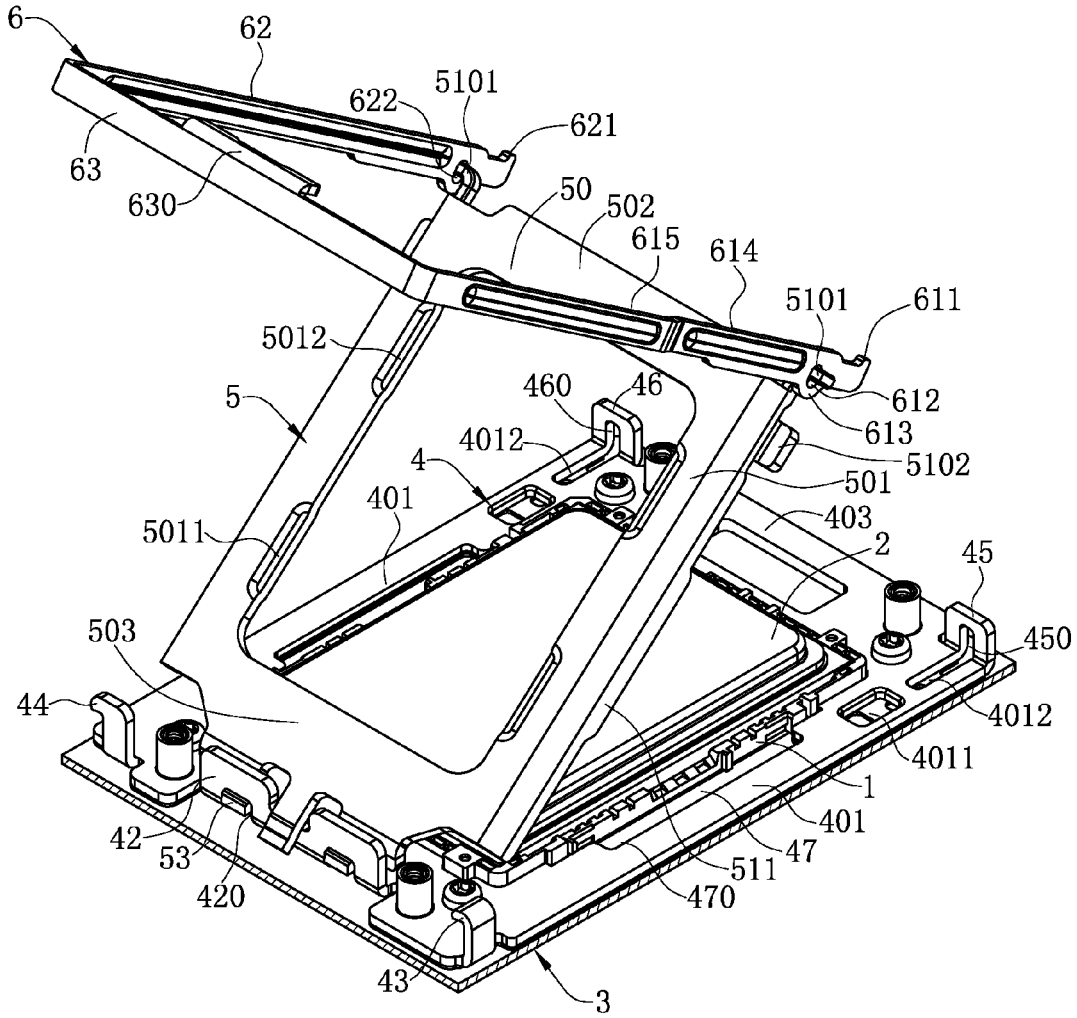
FIG. 2 is a schematic assembly view of FIG. 1.

As shown in FIG. 1 to FIG. 2, the stiffener 4 includes a bottom wall 40 in a flat plate shape. The bottom wall 40 includes two opposite first sides 401 and a second side 402 and a third side 403 connected to the two first sides 401. The two first sides 401, the second side 402 and the third side 403 together define a cavity 41 used for accommodating the socket 1. The second side 402 is provided with a cooperating portion 42 extending upward and pivoted to the load plate 5. The cooperating portion 42 is provided with two cooperation holes 420. The second side 402 is further provided with a first grab 43 and a second grab 44 used for locking the latch member 6. The first grab 43 and the second grab 44 are disposed at two sides of the cooperating portion 42, and the first grab 43 and the second grab 44 are consistent in opening direction (in other embodiments, the first grab 43 and the second grab 44 may be inconsistent in opening direction). The third side 403 is provided with a first locking sheet 45 and a second locking sheet 46 bending and extending upward. The first locking sheet 45 is provided with a first fixing hole 450, the second locking sheet 46 is provided with a second fixing hole 460, and the first fixing hole 450 and the second fixing hole 460 horizontally extend to the bottom wall 40. Each of the first sides 401 is provided with a reserved slot 47. The reserved slots 47 are disposed at two opposite sides of the cavity 41. The reserved slots 47 and the cavity 41 are in communication (in other embodiments, the reserved slots 47 and the cavity 41 may not be in communication). The length of the reserved slot 47 is less than the length of the bottom wall 40, and a stopping side 470 used for stopping the load plate 5 from moving in a lateral direction is formed at a side of the reserved slot 47. Each of the first sides 401 is further provided with a through-slot 4011 and a reserved hole 4012 located in front of the through-slot 4011. The reserved holes 4012 are respectively in communication with the first fixing hole 450 and the second fixing hole 460 (in other embodiments, neither of the reserved holes 4012 may be in communication with the first fixing hole 450 and the second fixing hole 460).

As shown in FIG. 1 to FIG. 6, the load plate 5 covers the socket 1. The load plate 5 includes a main body 50 used for pressing the chip module 2 and two side plates 51 extending downward from two opposite sides of the main body 50. The main body 50 is provided with two opposite lateral sides 501, and a front side 502 and a rear side 503 connected to the two lateral sides 501. The two lateral sides 501, the front side 502 and the rear side 503 together define an opening 52 used for the chip module 2 to pass through. Each of the lateral sides 501 is provided with a first pressing portion 5011. The first pressing portion 5011 is closer to the rear side 503 than the first pressing portion 5011 is to the front side 502. Each of the lateral sides 501 is further provided with a second pressing portion 5012 located in front of the first pressing portion 5011 (in other embodiments, the second pressing portion 5012 may be one or more in quantity, and may also be disposed at the front side 502). When the chip module 2 is installed onto the socket 1 and the load plate 5 is closed, the first pressing portion 5011 and the second pressing portion 5012 press the chip module 2 downward, and a distance D1 from the bottom surface of the first pressing portion 5011 to the top surface of the load plate 5 is greater than a distance D2 from the bottom surface of the second pressing portion 5012 to the top surface of the load plate 5 (in other embodiments, the distance D1 from the bottom surface of the first pressing portion 5011 to the top surface of the load plate 5 may also be less than the distance D2 from the bottom surface of the second pressing portion 5012 to the top surface of the load plate 5). The first pressing portion 5011 and the second pressing portion 5012 are both bumps formed by protruding downward from an inner edge of the opening 52 (in other embodiments, the first pressing portion 5011 and the second pressing portion 5012 are not merely limited to being formed by protruding downward from an inner edge of the opening 52, and are not merely limited to being bumps either). The side plate 51 is formed by the lateral side 501 by extending downward. The side plate 51 includes a base 510 and a protruding portion 511 extending downward from the base 510 (in other embodiments, the protruding portion 511 is not merely limited to being one in quantity). A distance S1 from a first side of the protruding portion 511 to a first side of the base 510 is less than the thickness S2 of a plate material of the stiffener 4. When the chip module 2 is not installed onto the socket 1 and the load plate 5 is closed, the protruding portion 511 is accommodated in the reserved slot 47, the base 510 is supported on the bottom wall 40, and a gap exists between the protruding portion 511 and the circuit board 3. When the chip module 2 is installed onto the socket 1 and the load plate 5 is closed, the protruding portion 511 is accommodated in the reserved slot 47, a distance between the first side of the base 510 and the bottom wall 40 is H1, a distance between the first side of the protruding portion 511 and the circuit board 3 is H2, and H2>H1. Two sides of the protruding portion 511 are provided with slant edges to make the width of the protruding portion 511 decrease from top downward, so as to guide the side plate 51 to enter the reserved slot 47. A tab 5101 extends outward from each of the side plates 51, and is used for being pivoted to the latch member 6. A pressed portion 5102 further extends outward from each of the side plates 51. The pressed portion 5102 is located at a position close to the first half of the side plate 51, is located behind the tab 5101, and is lower than the tab 5101. When the load plate 5 is closed, the pressed portion 5102 partially enters the through-slot 4011 (in other embodiments, the pressed portion 5102 may also not enter the through-slot 4011). The rear side 503 is provided with a pivoting portion 53 pivoted to the cooperation hole 420, and a gap exists between the pivoting portion 53 and an upper edge of the cooperation hole 420, so that the pivoting portion 53 can move upward in the cooperation hole 420. When the load plate 5 presses downward, the first pressing portion 5011 first contacts the chip module 2, and the load plate 5 continues to press downward by using the first pressing portion 5011 as a fulcrum. In this case, the second half of the load plate 5 moves upward by a distance by using the two first pressing portions 5011 as fulcrums, and damages of a terminal due to an excessively large force locally subjected to the chip module 2 can be avoided. Meanwhile, after the second pressing portion 5012 contacts the chip module 2, under the joint action of the two first pressing portions 5011, the chip module 2 can be kept balanced and be pressed downward slowly to be in stable contact with a terminal.

As shown in FIG. 1 to FIG. 4, the latch member 6 is a flat lever (in other embodiments, the lever is not merely limited to being flat). The latch member 6 includes a first arm 61 and a second arm 62 pivoted to the load plate 5 and located at two opposite sides of the load plate 5, and an operation arm 63 connected to the first arm 61 and the second arm 62 and located behind the pivoting portion 53 (in other embodiments, the lever may only include one arm, and the operation arm 63 is not merely limited to being located behind the pivoting portion 53). A free end of the first arm 61 and a free end of the second arm 62 are respectively provided with a buckling portion 611 and a buckling portion 621 passing through the first fixing hole 450 and the second fixing hole 460 and locked to the first locking sheet 45 and the second locking sheet 46. The first arm 61 and the second arm 62 are respectively provided with a pivoting hole 612 and a pivoting hole 622, and each of the pivoting hole 612 and the pivoting hole 622 is pivoted to the tab 5101. The pivoting holes 612 and 622 are oval (in other embodiments, the pivoting holes 612 and 622 are not merely limited to being oval), and a gap exists between each of the tabs 5101 and each of the upper edge and the lower edge of the corresponding pivoting holes 612 or 622. A protrusion 613 and a protrusion 623 protrude from the first arm 61 and the second arm 62 below the pivoting holes 612 and 622, and the reserved holes 4012 receive the protrusions 613 and 623. The first arm 61 and the second arm 62 press the pressed portion 5102 downward, the first fixing hole 450 and the first grab 43 jointly press the first arm 61 downward, and the second fixing hole 460 and the second grab 44 jointly press the second arm 62 downward, so that the load plate 5 is locked, and in this process, the tab 5101 is not subject to a force. The first arm 61 has a pivoting arm 614 engaging with the first fixing hole 450, and a connection arm 615 engaging with the first grab 43 and connected to the pivoting arm 614 and the operation arm 63. The connection arm 615 and the pivoting arm 614 deviate axially, the connection arm 615 is farther away from the load plate 5 than the pivoting portion 53, and the pivoting arm 614 is pivoted to the tab 5101 (in other embodiments, it is not merely limited to that the first arm 61 deviates axially). The operation arm 63 is provided with an operation portion 630 extending inward for an operator to operate the latch member 6.

Referring to FIG. 1 to FIG. 4, an assembly and use process of the electrical connector according to one embodiment of the present invention is roughly as follows.

At first, the socket 1 is soldered onto the circuit board 3, and then, the stiffener 4 is installed and fixed onto the circuit board 3, and the stiffener 4 surrounds the periphery of the socket 1.

Secondly, the pivoting portion 53 of the load plate 5 is inserted into the cooperation hole 420 at the back end of the stiffener 4, to implement pivoting of the load plate 5 and the stiffener 4.

Subsequently, the pivoting holes 612 and 622 of the first arm 61 and the second arm 62 of the latch member 6 are respectively aligned with the tabs 5101 at the two sides of the load plate 5 and inserted by the tabs 5101, so that the latch member 6 may rotate around the tab 5101 used as the axis, and in this case, a state of the electrical connector is shown in FIG. 2.

Figure 3:
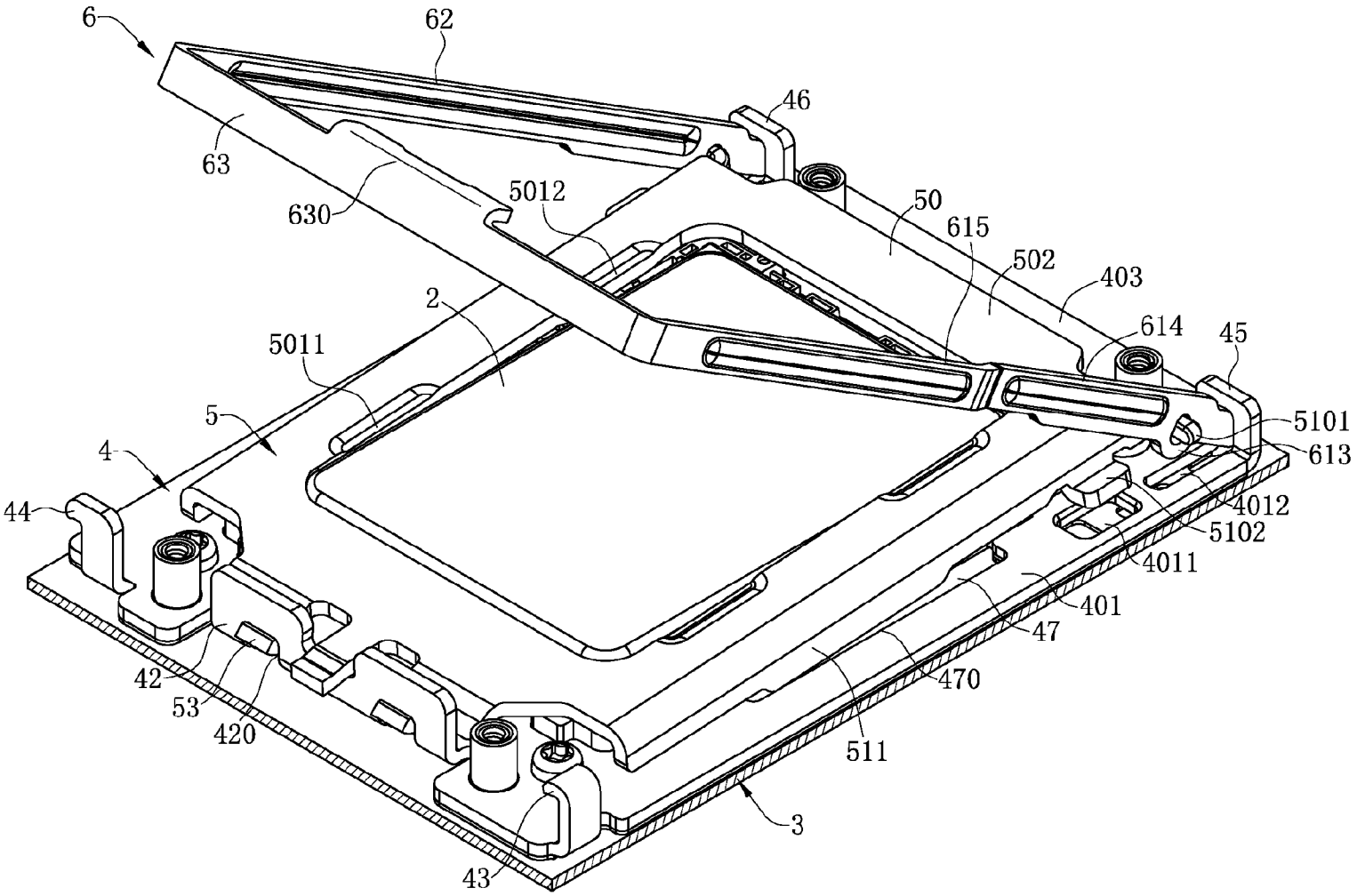
FIG. 3 is a schematic diagram showing that a load plate is close to a closed position, and a latch member partially enters a latch hole in FIG. 1.

After the chip module 2 is placed on the socket 1, the operation portion 630 on the operation arm 63 is grasped, and the first arm 61 and the second arm 62 are pushed obliquely downward, so that the load plate 5 rotates and moves toward a closed position, and the buckling portions 611 and 621 of the first arm 61 and the second arm 62 respectively enter a horizontal part of the first fixing hole 450 and a horizontal part of the second fixing hole 460, as shown in FIG. 3.

Then, the operation portion 630 is operated to make the first arm 61 and the second arm 62 rotate by using the tab 5101 as the axis, so that parts of the first arm 61 and the second arm 62 located behind the pivoting holes 612 and 622 rotate downward, and the buckling portions 611 and 621 move upward. When the first arm 61 and the second arm 62 urge upper parts of the first grab 43 and the second grab 44, the entire latch member 6 is deflected toward the right side by using the operation portion 630, so that the first arm 61 and the second arm 62 respectively cross the first grab 43 and the second grab 44.

Figure 4:
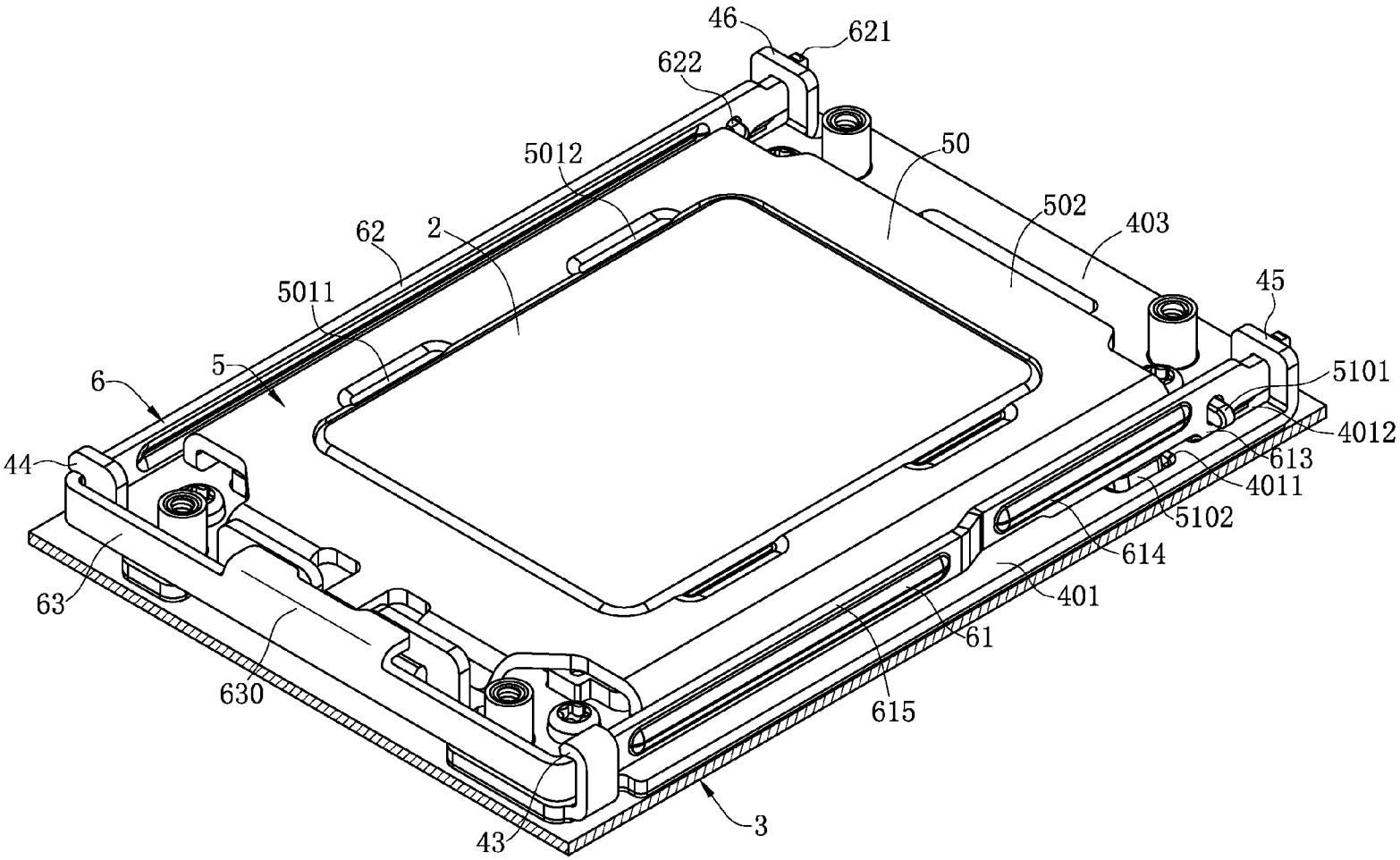
FIG. 4 is a schematic diagram showing that the load plate is in a closed state, and the latch member is snap-fitted in FIG. 3.
Figure 5:
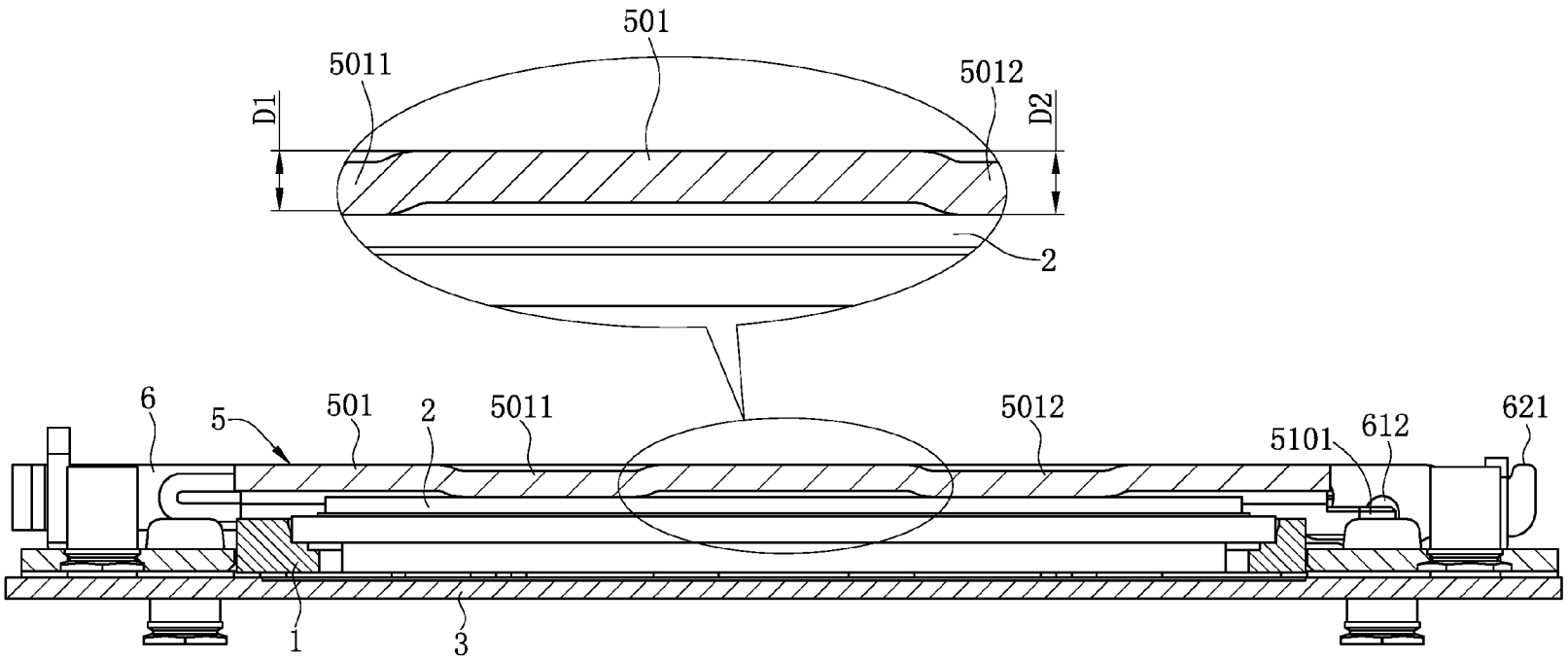
FIG. 5 is a sectional view of FIG. 4.
Figure 6:
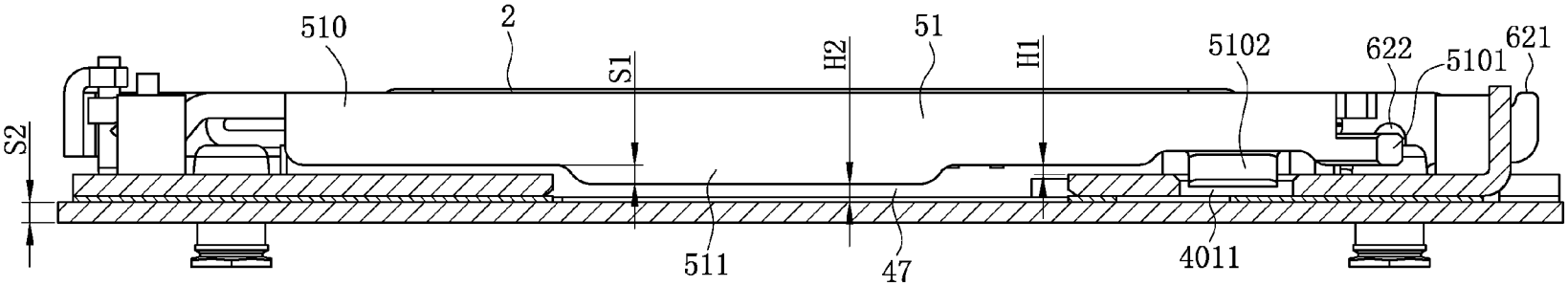
FIG. 6 is another sectional view of FIG. 4.

The latch member 6 continues to be rotated downward, and the first arm 61 and the second arm 62 rebound toward the left under their own elastic actions, so that the first arm 61 and the second arm 62 respectively snap-fit a lower part of the first grab 43 and a lower part of the second grab 44. Meanwhile, the first arm 61 and the second arm 62 tightly press the pressed portion 5102, the pressed portion 5102 partially enters the through-slot 4011 of the stiffener 4, and the buckling portions 611 and 621 respectively enter a vertical part of the first fixing hole 450 and a vertical part of the second fixing hole 460, and are locked to the first locking sheet 45 and the second locking sheet 46, as shown in FIG. 4 and FIG. 6. Finally, the load plate 5 presses the chip module 2 to ensure good electrical connection between the chip module 2 and the socket 1.

Figure 7:
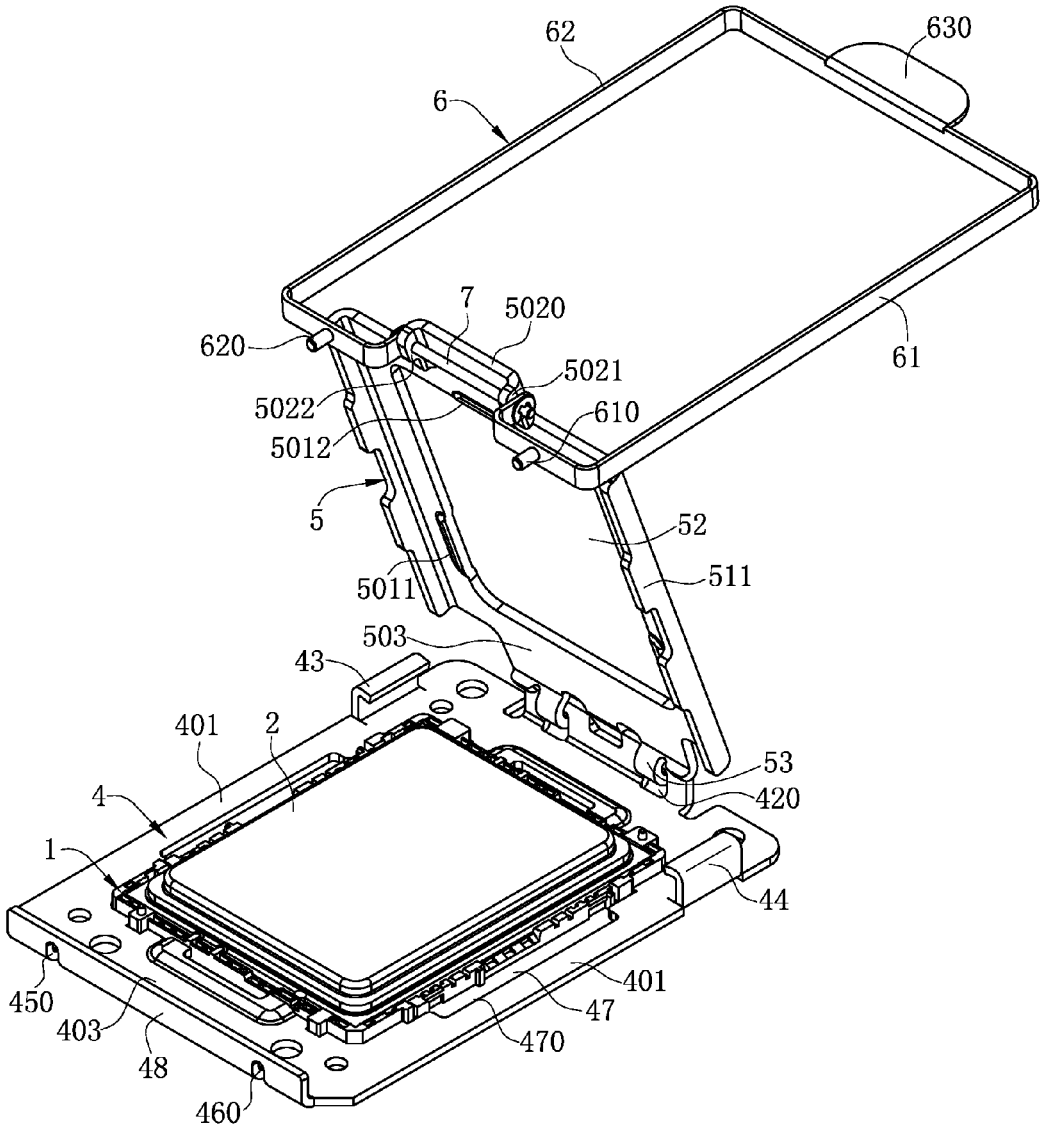
FIG. 7 is a schematic assembly view of a second embodiment of the electrical connector according to the present invention.
Figure 8:
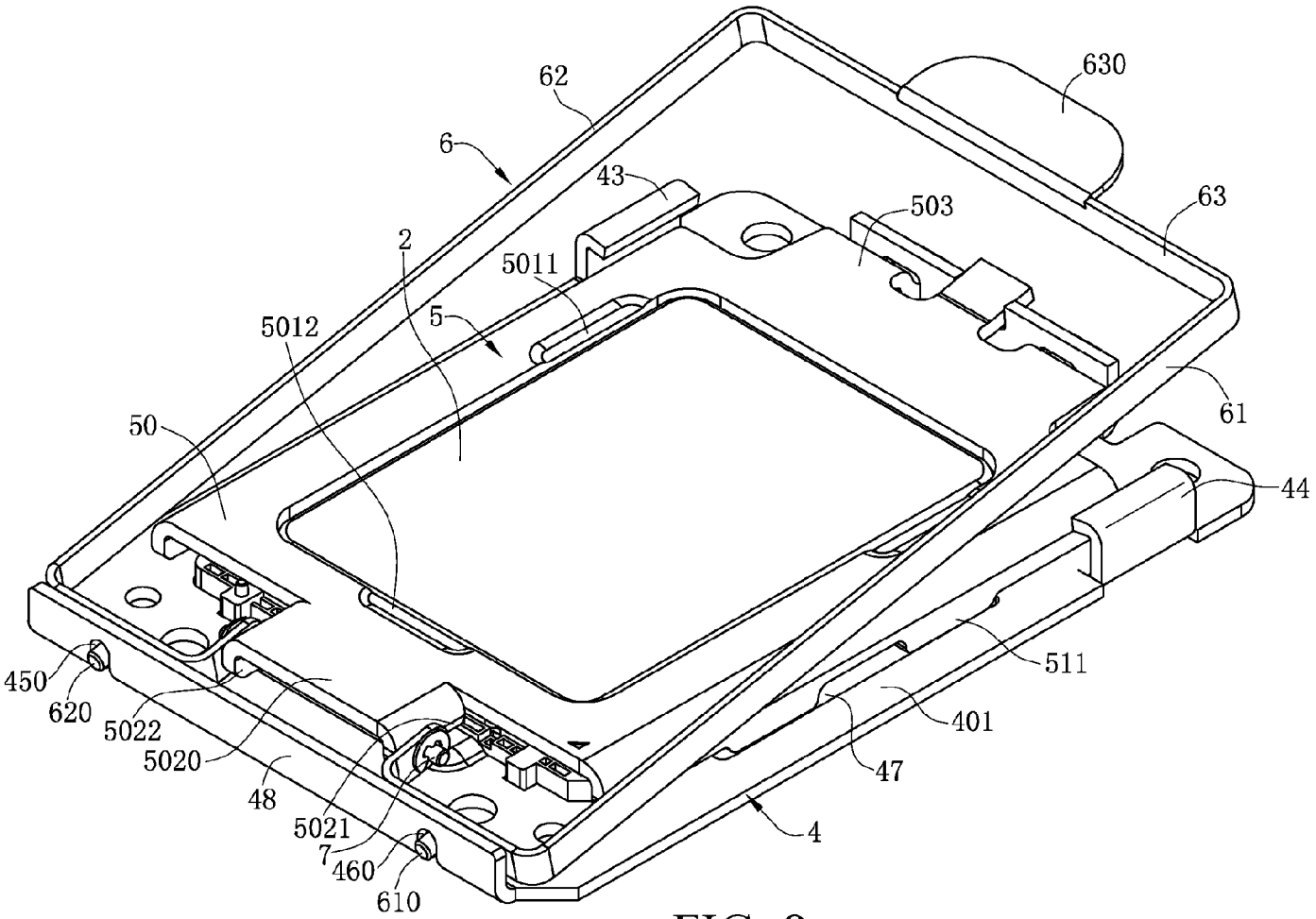
FIG. 8 is a schematic diagram showing that the load plate is located at a closed position, and the latch member is partially snap-fitted in FIG. 7.
Figure 9:
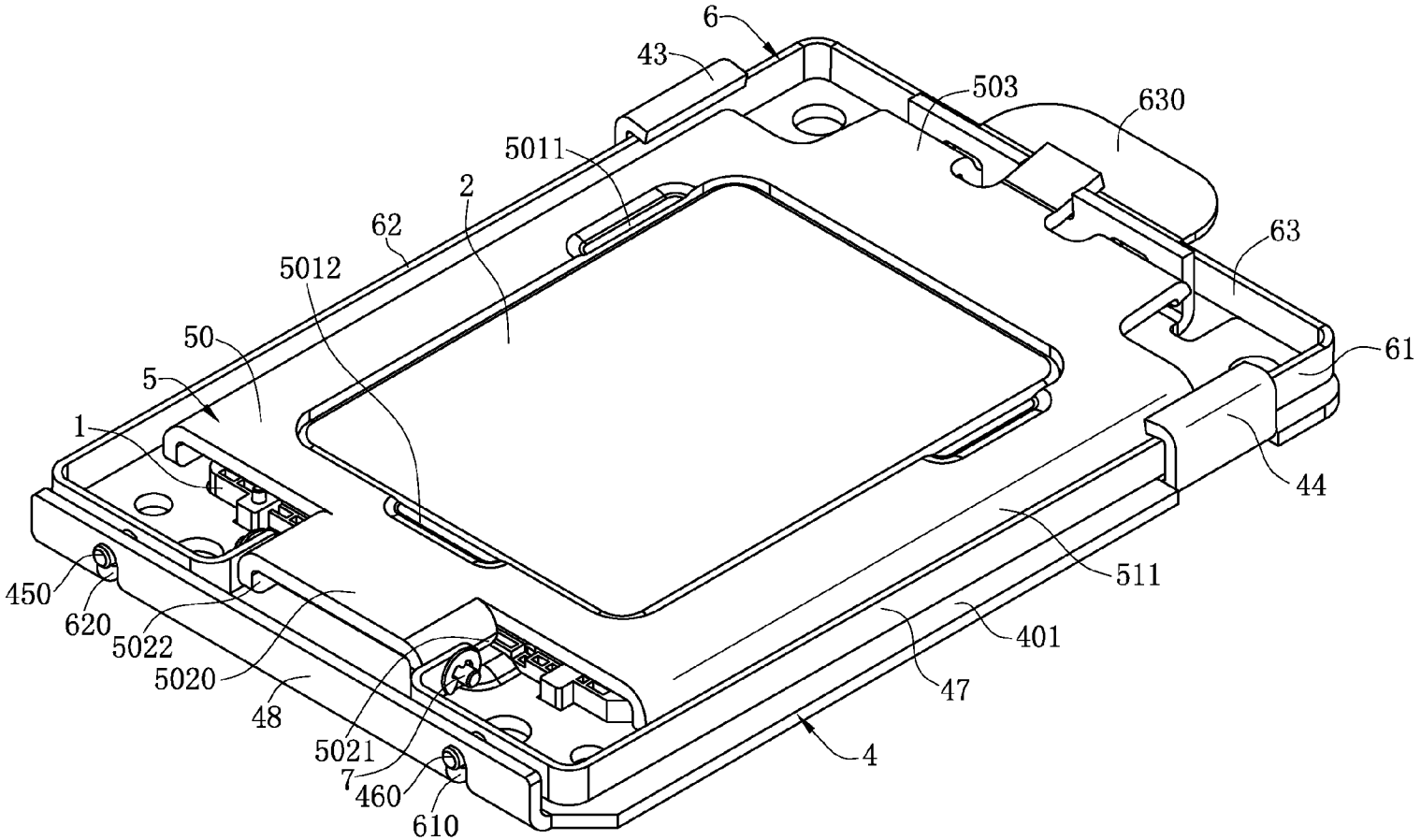
FIG. 9 is a schematic diagram showing that the load plate is in a closed state, and the latch member is snap-fitted in FIG. 7.

FIG. 7 to FIG. 9 show a second embodiment of the present invention, which is different from the previous embodiment in that:

(1) The second pressing portion 5012 is disposed at the front side 502 of the load plate 5, and the second pressing portion 5012 is one in quantity (in other embodiments, the pressing portion is not merely limited to being one in quantity).

(2) An extending portion 5020 extends forward from the front side 502 of the load plate 5, a side wall 5021 extends downward from each of two opposite sides of the extending portion 5020, each side wall 5021 is provided with a through-hole 5022, a pivoting pin 7 is installed into the pivoting holes 612 and 622 and the through-hole 5022, so that the latch member 6 is pivoted to the load plate 5.

(3) The first grab 43 and the second grab 44 are opposite in opening direction.

(4) The operation arm 63 of the latch member 6 is provided with an operation portion 630 extending outward for an operator to operate the latch member 6, and the first arm 61 does not deviate axially to be divided into two shaft portions.

(5) The third side 403 is provided with a blocking sheet 48 extending upward, the first fixing hole 450 and the second fixing hole 460 are both disposed on the blocking sheet 48, the first arm 61 and the second arm 62 are respectively provided with protruding columns 610 and 620 protruding outward and locked to the first fixing hole 450 and the second fixing hole 460.

Figure 10:
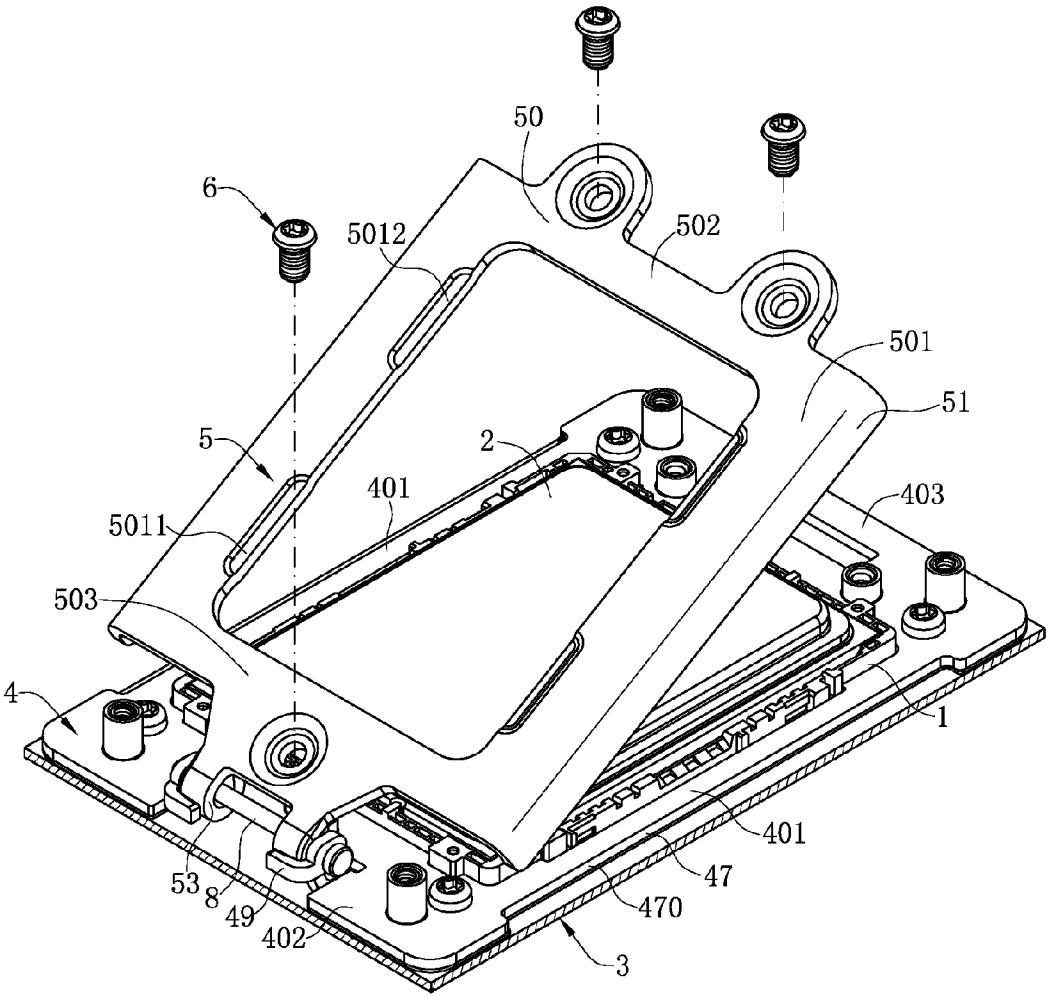
FIG. 10 is a schematic assembly view of a third embodiment of the electrical connector according to the present invention.
Figure 11:
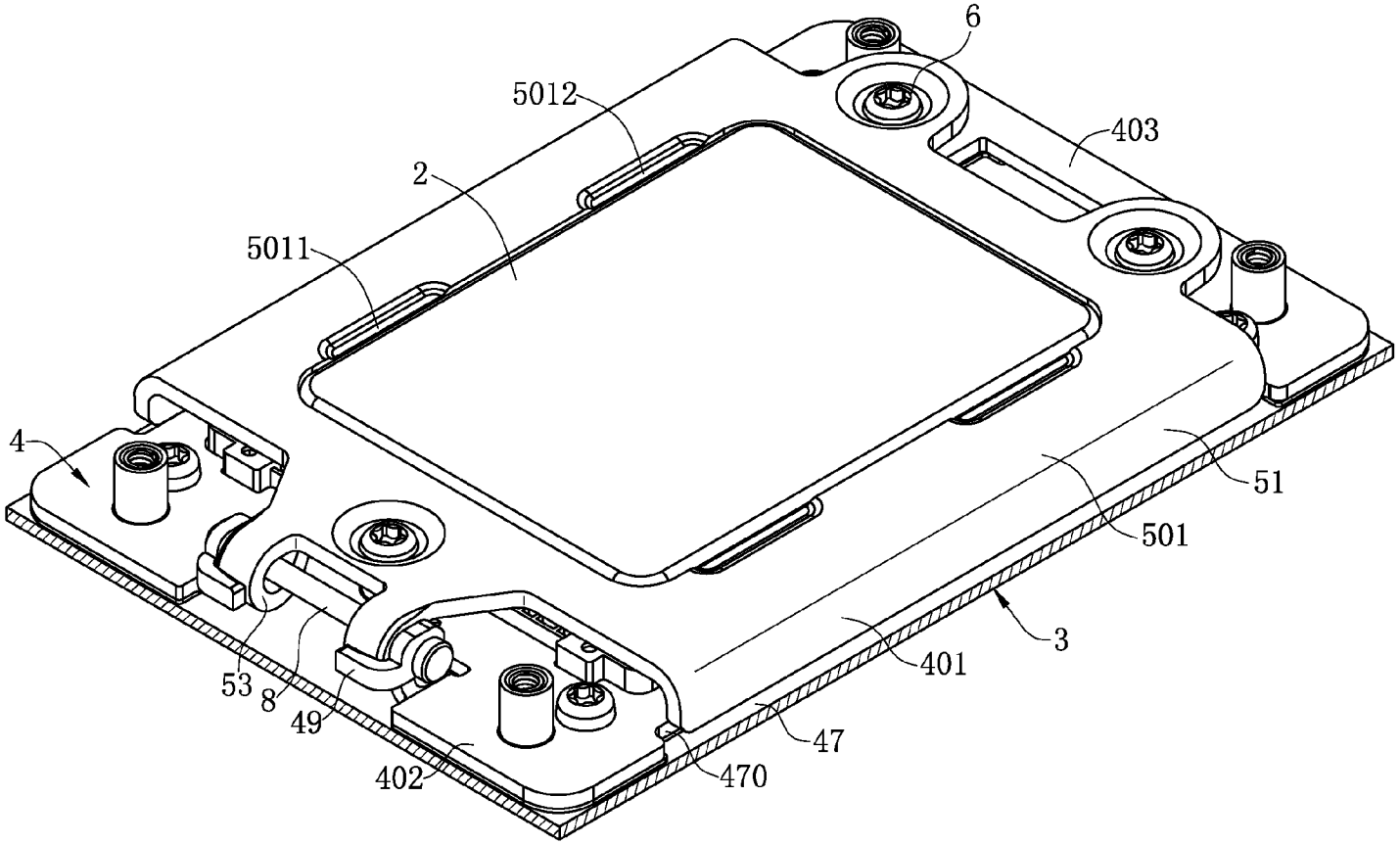
FIG. 11 is a schematic diagram showing that the load plate is in a closed state, and the latch member is snap-fitted in FIG. 10.

FIG. 10 and FIG. 11 show a third embodiment of the present invention, which is different from the previous two embodiments in that:

(1) The pivoting portion 53 and the cooperation hole 420 are pivoted to each other by using a pivoting shaft 8, and the stiffener 4 is further provided with a stopping portion 49 located behind the pivoting portion 53 and stopping the load plate 5 from rotating excessively.

(2) The reserved slot 47 is formed by two opposite first sides 401 of the bottom wall 40 by being depressed inward from the outer side, the reserved slot 47 and the cavity 41 are not in communication (in other embodiments, the reserved slot 47 and the cavity 41 may also be in communication), the length of the reserved slot 47 is less than the length of the bottom wall 40, the length of the side plate 51 is less than the length of the reserved slot 47, and when the load plate 5 is closed, the side plate 51 is accommodated in the reserved slot 47.

(3) The latch members 6 are screws, and are totally three in quantity, the rear side 503 of the load plate 5 is latched by a screw, and the front side 502 of the load plate 5 is latched by two screws (in other embodiments, the screw may only latch the front side 502 of the load plate 5, and the quantity of screws is not limited).

In summary, the electrical connector according to certain embodiments of the present invention, among other things, has the following beneficial advantages.

(1) The distance from the bottom surface of the second pressing portion 5012 to the top surface of the load plate 5 is less than the distance from the bottom surface of the first pressing portion 5011 to the top surface of the load plate 5, and in the process in which the load plate 5 presses the chip module 2 downward, because a gap exists between the pivoting portion 53 and an upper edge of the cooperation hole 420, the pivoting portion 53 may move upward in the cooperation hole 420. When the load plate 5 presses downward, the first pressing portion 5011 first contacts the chip module 2, the load plate 5 continues to press downward by using the first pressing portion 5011 as a fulcrum, and in this case, the second half of the load plate 5 moves upward by a distance by using the two first pressing portions 5011 as fulcrums, and damages of a terminal due to an excessively large force locally subjected to the chip module 2 may be avoided. Meanwhile, after the second pressing portion 5012 contacts the chip module 2, the chip module 2 is subject to an even force under a joint action of the two first pressing portions 5011, and the chip module 2 may be kept balanced and press downward slowly to be in stable contact with the terminal, so as to avoid damaging the terminal since the chip module 2 is locally subject to an excessively large force.

(2) The first grab 43 and the second grab 44 are consistent in orientation, so that after deflecting toward a same direction, the first arm 61 and the second arm 62 are fastened to or are disengaged from the first grab 43 and the second grab 44, and it may be implemented that by operating the latch member 6 with one hand, the first grab 43 and the second grab 44 are fastened or disengaged in one step, which is convenient to operate.

(3) A gap exists between the tab 5101 and each of the upper edge and the lower edge of each of the pivoting holes 612 and 622, and when the latch member 6 latches the load plate 5, the tab 5101 has a space for moving up and down, and may not be subject to a force, thereby avoiding breaking the tab 5101 caused by an excessively large force to which the tab 5101 is subject.

(4) The stiffener is provided with a through-slot 4011 receiving the pressed portion 5102, so it avoid that the pressed portion 5102 resists the bottom wall 40, thus the load plate 5 can still be locked to an accurate position.

(5) The connection arm 615 is farther away from the load plate 5 than the pivoting arm 614. When the latch member 6 is taken out from the first grab 43, because the connection arm 615 is farther away from the load plate 5, the load plate 5 may be avoided, to prevent the connection arm 615 from resisting the load plate 5 to hinder the first arm 61 from being locked or disengaged.

(6) Each of the front side 502 and the rear side 503 is provided with the latch member 6, and when the chip module 2 is installed onto the socket 1 and the load plate 5 is closed, the latch member 6 latches the load plate 5 onto the stiffener 4. Because two ends of the load plate 5 are subject to a downward pressure, the middle of the load plate 5 hunches up, and a gap exists between the side plate 51 and the circuit board 3, so as to prevent the side plate 51 from pressing against the circuit board 3 to damage the circuit board 3.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a socket for electrically connecting with a chip module;

a stiffener disposed around the periphery of the socket;

a load plate covering the socket, comprising:

two opposite lateral sides, and a front side and a rear side connected to the two lateral sides, wherein the two lateral sides, the front side and the rear side together define an opening for the chip module to pass through;

a pivoting portion disposed on the rear side, such that the load plate is rotatable about the pivoting portion;

a first pressing portion disposed at each of the lateral sides; and a second pressing portion located in front of the first pressing portion, wherein when the chip module is installed onto the socket and the load plate is closed, the first pressing portion and the second pressing portion press the chip module downward, and a distance from a bottom surface of the second pressing portion to a top surface of the load plate is unequal to a distance from a bottom surface of the first pressing portion to the top surface of the load plate; and a latch member, latching the load plate onto the stiffener.

2. The electrical connector according to claim 1, wherein the distance from the bottom surface of the first pressing portion to the top surface of the load plate is greater than the distance from the bottom surface of the second pressing portion to the top surface of the load plate.

3. The electrical connector according to claim 1, wherein the first pressing portion is nearer to the rear side than the first pressing portion is to the front side.

4. The electrical connector according to claim 1, wherein the second pressing portion is disposed at the front side.

5. The electrical connector according to claim 1, wherein the second pressing portion is disposed at the lateral side.

6. The electrical connector according to claim 1, wherein the stiffener comprises a cooperation hole pivotally attached to the pivoting portion, and a gap exists between the pivoting portion and an upper edge of the cooperation hole, so that the pivoting portion is movable upward in the cooperation hole.

7. The electrical connector according to claim 1, wherein the first pressing portion and the second pressing portion protrude from an inner edge of the opening downward, and the first pressing portion and the second pressing portion are bumps.

8. The electrical connector according to claim 1, wherein the latch member comprises a first arm and a second arm disposed opposite to each other and pivoted to the load plate, and an operation arm connected to the first arm and the second arm and located behind the pivoting portion; and the stiffener comprises a first grab and a second grab close to two ends of the operation arm, a first fixing hole in front of the first grab, and a second fixing hole in front of the second grab, the first fixing hole and the first grab jointly press the first arm downward, and the second fixing hole and the second grab jointly press the second arm downward.

9. The electrical connector according to claim 8, wherein the first arm comprises a pivoting arm engaging with the first fixing hole, and a connection arm engaging with the first grab and connected to the pivoting arm and the operation arm, the connection arm and the pivoting arm axially offset from each other, the connection arm is farther away from the load plate than the pivoting arm, and the pivoting arm is pivotally attached to the load plate.

10. The electrical connector according to claim 8, wherein the first grab and the second grab are consistent in orientation, so that after the first arm and the second arm deflecting toward a same direction, the first arm and the second arm are fastened to the first grab and the second grab.

11. The electrical connector according to claim 8, wherein a tab extends outward from each of two opposite sides of the load plate, each of the first arm and the second arm is provided with a pivoting hole pivoted to the tab, and a gap exists between the tab and each of an upper edge and a lower edge of the pivoting hole.

12. The electrical connector according to claim 11, wherein each of the first arm and the second arm has a protrusion below the pivoting hole, and the stiffener is provided with a reserved hole receiving the protrusion.

13. The electrical connector according to claim 8, wherein a pressed portion extends outward from each of two opposite sides of the load plate, and each of the first arm and the second arm press the pressed portion downward.

14. The electrical connector according to claim 13, wherein the stiffener comprises a through-slot receiving the pressed portion.

15. The electrical connector according to claim 1, wherein each of the front side and the rear side is provided with the latch member.

16. The electrical connector according to claim 1, wherein the stiffener comprises a stopping portion located behind the pivoting portion for stopping the load plate from excessively rotating backward.

* * * * *